US009050833B2

(12) United States Patent
Shiiya

(10) Patent No.: US 9,050,833 B2
(45) Date of Patent: Jun. 9, 2015

(54) IMAGE RECORDING APPARATUS WITH A HEAT TRANSPORT MEMBER

(71) Applicant: SEIKO EPSON CORPORATION, Tokyo (JP)

(72) Inventor: Tomoyuki Shiiya, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/185,082

(22) Filed: Feb. 20, 2014

(65) Prior Publication Data

US 2014/0267518 A1 Sep. 18, 2014

(30) Foreign Application Priority Data

Mar. 18, 2013 (JP) ..... 2013-054691

(51) Int. Cl.
*B41J 2/01* (2006.01)
*B41J 11/00* (2006.01)
*B41J 29/377* (2006.01)

(52) U.S. Cl.
CPC ..... *B41J 11/002* (2013.01); *B41J 29/377* (2013.01)

(58) Field of Classification Search
None
See application file for complete search history.

(56) References Cited

U.S. PATENT DOCUMENTS

2011/0199449 A1* 8/2011 Oyanagi et al. ..... 347/102
2012/0133716 A1* 5/2012 Aizawa et al. ..... 347/102
2012/0249706 A1 10/2012 Oyanagi et al.

FOREIGN PATENT DOCUMENTS

| | | |
|---|---|---|
| JP | 2008-173968 | 7/2007 |
| JP | 2008-100399 | 5/2008 |
| JP | 2010-000735 | 1/2010 |
| JP | 2010-089375 | 4/2010 |
| JP | 2012-030442 | 2/2012 |
| JP | 2012-158188 | 8/2012 |

* cited by examiner

*Primary Examiner* — Geoffrey Mruk
*Assistant Examiner* — Bradley Thies
(74) *Attorney, Agent, or Firm* — Workman Nydegger

(57) ABSTRACT

An image recording apparatus includes an ejecting head which ejects photocurable liquid onto the recording medium; and a light irradiator which radiates the light to the liquid which is ejected onto the recording medium, in which the light irradiator includes a light source substrate which is arranged so as to face the recording medium, and includes a light source which radiates the light to the recording medium; a heat transport member which includes a portion to be connected which is in thermal contact with the light source substrate, and a portion to be cooled which is located at a position which is further separated from the light source substrate than the portion to be connected, and transports heat from the portion to be connected to the portion to be cooled; and a cooling fan which cools down the portion to be cooled.

10 Claims, 3 Drawing Sheets

IMAGE RECORDING APPARATUS WITH A HEAT TRANSPORT MEMBER

BACKGROUND

1. Technical Field

The present invention relates to a technology in which a light source of a light irradiator emitting light which cures photocurable liquid from the light source is cooled down in an image recording apparatus which records an image on a recording medium using ejecting heads which eject the liquid.

2. Related Art

In JP-A-2010-000735, a printer which includes printer heads ejecting ultraviolet (UV) ink which is cured by being irradiated with UV rays, and a light source unit which radiates UV rays to UV ink which is landed on a printing medium is disclosed. The light source unit cures the UV ink by radiating the UV rays to the printing medium by emitting the UV rays from a light source facing the printing medium. In addition, the light source unit includes a fan which is arranged so as to face the light source, and suppresses a temperature rise in the light source by cooling down the light source using wind which is generated by the fan. In this manner, it is possible to suppress a change in illuminance of the light source which is caused by the temperature rise, and to stabilize the illuminance of the light source.

Meanwhile, in the image recording apparatus, the light source is cooled down by arranging the fan so as to face the light source, and causing wind which is generated by the fan to get to the light source directly. In such a configuration, it is preferable that the fan be arranged so as to be close to the light source, and to cause wind which is generated by the fan to get to the light source reliably, in order to efficiently cool down the light source. However, there has been a case in which, when the fan is set to be close to the light source, warm air in the vicinity of the light source is sent to the light source by the fan, and as a result, it is difficult to improve cooling efficiency of the light source.

SUMMARY

An advantage of some aspects of the invention is to provide a technology in which a light source of a light irradiator emitting light which cures photocurable liquid from the light source is efficiently cooled down, in an image recording apparatus which records an image on a recording medium using ejecting heads which eject the liquid.

An image recording apparatus according to an aspect of the invention includes an ejecting head which is arranged so as to face a recording medium, and ejects photocurable liquid which is cured by being irradiated with light onto the recording medium; and a light irradiator which radiates the light to the liquid which is ejected onto the recording medium by the ejecting head, in which the light irradiator includes a light source substrate which is arranged so as to face the recording medium, and includes a light source which radiates the light to the recording medium; a heat transport member which includes a portion to be connected which is in thermal contact with the light source substrate by being connected to the light source substrate directly or indirectly, and a portion to be cooled which is located at a position which is further separated from the light source substrate than the portion to be connected, and transports heat from the portion to be connected to the portion to be cooled; and a cooling fan which is arranged so as to face the portion to be cooled, and cools down the portion to be cooled.

In the aspect of the invention (image recording apparatus) with such a configuration, the light irradiator which has the light source substrate arranged so as to face the recording medium is included, and the light source which radiates light to liquid is provided in the light source substrate. In addition, the portion to be connected of the heat transport member which transports heat to the portion to be cooled from the portion to be connected is directly or indirectly connected to the light source substrate, and is in thermal contact with the light source substrate. On the other hand, the portion to be cooled of the heat transport member is located at a position which is further separated from the light source substrate than the portion to be connected, and the cooling fan is arranged so as to face the portion to be cooled which is drawn out from the light source substrate in this manner, and cools down the portion to be cooled. Accordingly, heat of the light source is transported to the portion to be cooled of the heat transport member which is separated from the light source substrate through the portion to be connected of the heat transport member which is connected to the light source substrate. In addition, the heat of the light source which is transported to the portion to be connected is lost due to the cooling fan.

Moreover, the cooling fan faces the portion to be connected of the heat transport member which is drawn out from the light source substrate, and is arranged by being separated from the light source. For this reason, it is possible for the cooling fan to cool down the portion to be cooled using air which is relatively cooler than air in the vicinity of the light source, and to efficiently radiate the heat of the light source which is transported to the portion to be cooled. As a result, in the aspect of the invention, it is possible to efficiently cool down the light source of the light irradiator.

The image recording apparatus may further include an exterior member which accommodates the recording medium, the ejecting head, and the light irradiator, in which the cooling fan cools down the portion to be cooled using air which is taken in from an outside of the exterior member. In such a configuration, it is possible to cool down the portion to be cooled using cool air which is taken in from the outside of the exterior member, and to contribute to an improvement of cooling efficiency of the light source of the light irradiator.

In the image recording apparatus, the cooling fan may discharge air which cools down the portion to be cooled to the outside of the exterior member. In such a configuration, since warmed air which is used when cooling down the portion to be cooled is discharged to the outside of the exterior member, it is possible to maintain an internal temperature of the exterior member relatively low, and to contribute to the improvement of cooling efficiency of the light source of the light irradiator.

In the image recording apparatus, the exterior member may include an air inlet and an air outlet which are open to the outside, and the cooling fan may discharge air which is taken in from the air inlet from the air outlet after using the air in cooling down of the portion to be cooled. At this time, the image recording apparatus may further include a ventilation member which is provided between the air inlet and the air output, and guides air from the air inlet to the air outlet, in which the portion to be cooled and the cooling fan are arranged on a guiding path on which the ventilation member guides air. By providing the ventilation member which guides air in this manner, it is possible to efficiently take in cool air from the outside of the exterior member, to use when cooling down the portion to be cooled, and to efficiently discharge the air which is warmed by being used when cooling down the portion to be cooled to the outside of the exterior member. Moreover, according to the invention, the portion to be cooled of the heat transport member is located at a position which is drawn from the light source. Accordingly, it is not necessary to extend the ventilation member to the light source from the air inlet or the air outlet, and it is possible to make the ventilation member relatively short.

The image recording apparatus, the light irradiator may further include a heat radiation member which is connected to the portion to be cooled directly or indirectly at a position which faces the cooling fan, and is in thermal contact with the portion to be cooled. By providing the heat radiation member at the portion to be cooled in this manner, it is possible to further improve the cooling efficiency of the light source of the light irradiator by further efficiently radiating heat from the portion to be cooled.

Meanwhile, in the aspect of the invention, the cooling fan faces the portion to be cooled of the heat transport member which is drawn from the light source substrate, and is arranged by being separated from the light source. In other words, since the cooling fan for cooling down the light source is separated from the vicinity of the light source, it is possible to use a space in the vicinity of the light source as a space for arranging components other than the cooling fan for the light source. Therefore, in the image recording apparatus, the light irradiator may further include a drive circuit substrate which includes a circuit driving the light source of the light source substrate, and the drive circuit substrate may be arranged so as to align with the heat transport member between the light source substrate and the portion to be cooled by making use of advantages of such a layout. In such a configuration, it is possible to arrange the drive circuit substrate so as to be close to the light source using the space in the vicinity of the light source. As a result, for example, it is possible to reduce influence of noise on wiring by making the wiring from the drive circuit substrate to the light source short.

Incidentally, various specific configurations can be adopted for the heat transport member. In the image recording apparatus, the heat transport member may be a heat pipe.

In the image recording apparatus, the heat pipe may include a first region which extends in parallel to a main surface of the light source substrate, a second region which extends in a direction which is further separated from the light source substrate than the first region by extending in a direction which crosses the main surface of the light source substrate by being bent from the first region, in which the portion to be connected is provided in the first region, and the portion to be cooled is provided in the second region. In such a configuration, it is possible to radiate heat of the light source which is transported to the portion to be cooled using the cooling fan which faces the portion to be cooled which is provided in the second region of the heat pipe, by connecting the first region of the heat pipe to the light source substrate, and on the other hand, by drawing the second region of the heat pipe from the light source substrate. For this reason, it is possible for the cooling fan to cool down the portion to be cooled using air which is relatively cooler than air in the vicinity of the light source, and to efficiently radiate the heat of the light source which is transported to the portion to be cooled. As a result, it is possible to efficiently cool down the light source of the light irradiator.

In the image recording apparatus, at least a part of the portions to be cooled may be arranged at a position which is farther from the recording medium than an end portion of the ejecting head on a side which is opposite to a recording medium side. Accordingly, in such a configuration, it is not necessary to extend the ventilation member from the air inlet or the air outlet to the light source, and it is possible to make the ventilation member short, compared to a case in which the ventilation member is extended from the air inlet or the air outlet to the light source. Since it is possible to make the ventilation member short in this manner, a pressure loss of an air current due to the cooling fan can be reduced. Accordingly, cooling efficiency is increased compared to a case in which a long ventilation member is used, when the same cooling fan is used.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
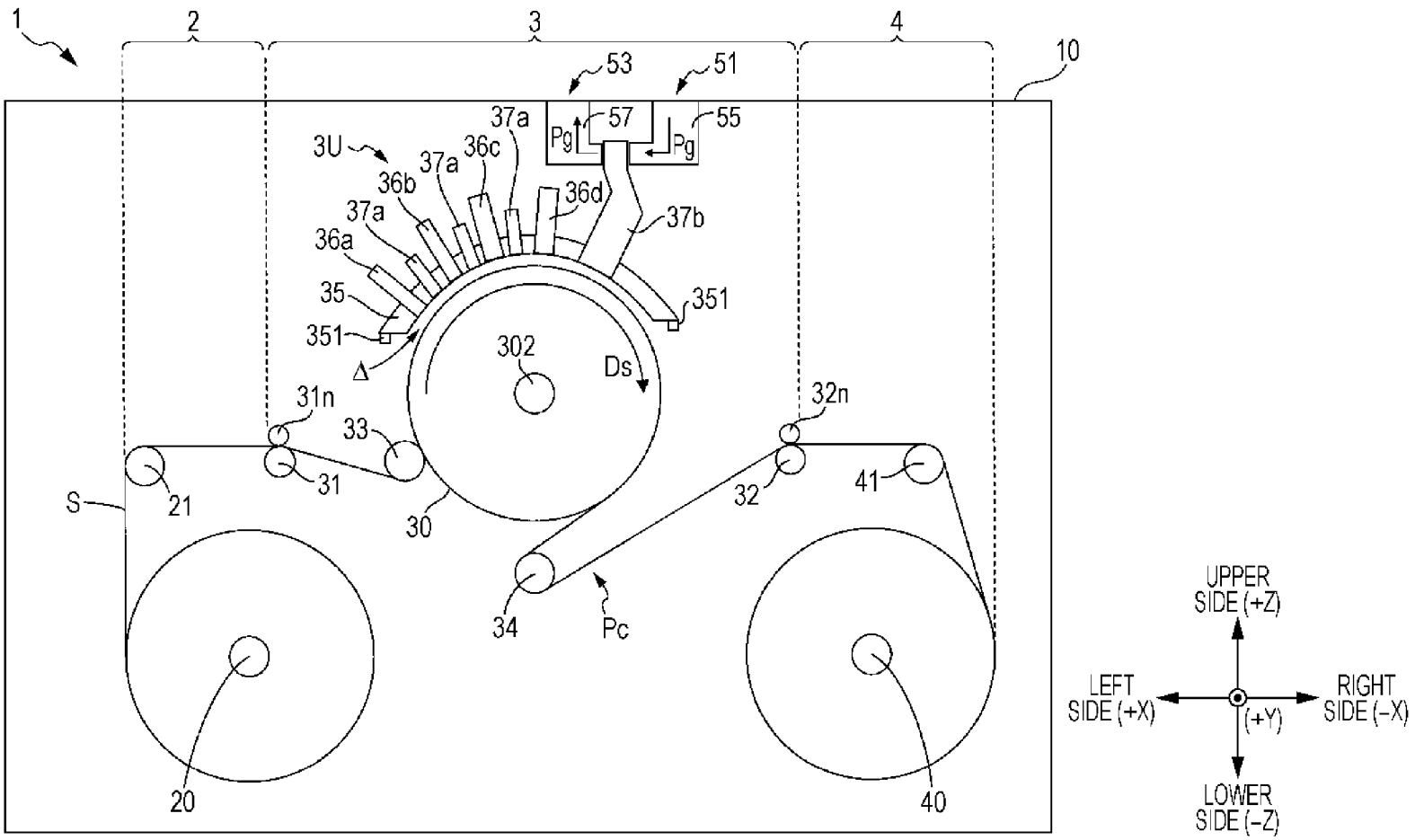
FIG. 1 is a front view which schematically exemplifies a configuration of a printing device to which the present invention can be applied.

FIG. 1 is a front view which schematically illustrates a configuration of a printing device to which the present invention can be applied. In addition, an XYZ orthogonal coordinate system corresponding to the horizontal direction X, the forward and backward direction Y, and the vertical direction Z of a printing device 1 is displayed in order to make an arrangement relationship in each unit of the device clear in FIG. 1.

In a printing device 1, a feeding unit 2, a processor 3, and a winding unit 4 are arranged in the horizontal direction X, and each of the functional units 2, 3, and 4 are accommodated in a housing member 10. The feeding unit 2 and the winding unit 4 include a feeding axis 20 and a winding axis 40, respectively. In addition, both ends of a sheet S (web) are wound around a roll shape in the feeding axis 20 and the winding axis 40, and are stretched between the axes. The sheet S is transported to the processor 3 from the feeding axis 20 along a path Pc which is stretched in this manner, is subject to a printing process using a process unit 3U, and then is transported to the winding axis 40. A type of the sheet S is roughly classified into paper types and film types. As a specific example, there is fine quality paper, cast coated paper, art paper, coated paper, or the like, for the paper system, and there is synthetic paper, Polyethylene terephthalate (PET), polypropylene (PP), or the like, for the film system. In addition, in the following descriptions, a face on which an image is printed is referred to as the front surface from either of surfaces of the sheet S, and on the other hand, a face on the opposite side thereof is referred to as the rear surface.

The feeding unit 2 includes the feeding axis 20 which winds an end of the sheet S, and a driven roller 21 which winds up the sheet S which is drawn from the feeding axis 20. The feeding axis 20 supports the end of the sheet S by winding the sheet in a state in which the front surface of the sheet S is caused to face the outside. In addition, when the feeding axis 20 rotates clockwise on a paper plane in FIG. 1, the sheet S which is wound around the feeding axis 20 is sent out to the processor 3 via the driven roller 21. Incidentally, the sheet S is wound around the feeding axis 20 through a core tube (not shown) which is detachable from the feeding axis 20. Accordingly, when the sheet S of the feeding axis 20 is used up, it is possible to exchange the sheet S of the feeding axis 20 by mounting a new core tube in which a roll shaped sheet S is wound on the feeding axis 20.

The processor 3 performs processing using the process unit 3U which is arranged along the outer peripheral surface of a rotating drum 30 while supporting the sheet S which is fed from the feeding unit 2 in the rotating drum 30, and prints an image on the sheet S. The processor 3 is provided with a front driving roller 31 and a rear driving roller 32 on both sides of the rotating drum 30, the sheet S which is transported from the front driving roller 31 to the rear driving roller 32 is supported by the rotating drum 30, and is printed with an image.

The front driving roller 31 includes a plurality of minute protrusions which are formed using thermal spraying on the outer peripheral surface, and winds up the sheet S which is fed from the feeding unit 2 from the rear surface side. In addition, the front driving roller 31 transports the sheet S which is fed from the feeding unit 2 to the downstream side of a transport path by rotating clockwise on the paper plane in FIG. 1. In addition, a nip roller 31*n* is provided with respect to the front driving roller 31. The nip roller 31*n* comes into contact with the front surface of the sheet S in a state of being urged to the front driving roller 31 side, and interposes the sheet S between the nip roller and the front driving roller 31. In this manner, a friction force between the front driving roller 31 and the sheet S is secured, and it is possible to reliably transport the sheet S using the front driving roller 31.

The rotating drum 30 is a drum of a cylindrical shape with a center line which is parallel in the Y direction, and winds up the sheet S on the outer peripheral surface thereof. In addition, the rotating drum 30 includes a rotational axis 302 which extends in the axial direction through the center line of the cylindrical shape. The rotational axis 302 is rotatably supported by a support mechanism which is not shown, and the rotating drum 30 rotates about the rotational axis 302.

The sheet S which is transported from the front driving roller 31 to the rear driving roller 32 is wound up from the rear surface side on the outer peripheral surface of such a rotating drum 30. In addition, the rotating drum 30 supports the sheet S from the rear surface side while rotating in the transport direction Ds of the sheet S by being driven by receiving a friction force between the drum and the sheet S. Incidentally, driven rollers 33 and 34 which turn the sheet S inside out on both sides of a winding portion with respect to the rotating drum 30 are provided in the processor 3. The driven roller 33 between the two rollers winds up the front surface of the sheet S between the front driving roller 31 and the rotating drum 30, and turns the sheet S inside out. On the other hand, the driven roller 34 winds up the front surface of the sheet S between the rotating drum 30 and the rear driving roller 32, and turns the sheet S inside out. In this manner, it is possible to secure a long winding portion of the sheet S with respect to the rotating drum 30 by turning the sheet S inside out on the respective upstream side and downstream side in the transport direction Ds with respect to the rotating drum 30.

The rear driving roller 32 includes a plurality of minute protrusions which are formed using thermal spraying on the outer peripheral surface, and winds up the sheet S which is transported from the rotating drum 30 through the driven roller 34 from the rear surface side. In addition, the rear driving roller 32 transports the sheet S to the winding unit 4 by rotating clockwise on the paper plane in FIG. 1. In addition, a nip roller 32*n* is provided with respect to the rear driving roller 32. The nip roller 32*n* comes into contact with the front surface of the sheet S in a state of being urged to the rear driving roller 32 side, and interposes the sheet S between the roller and the rear driving roller 32. In this manner, a friction force between the rear driving roller 32 and the sheet S is secured, and it is possible to reliably transport the sheet S using the rear driving roller 32.

In this manner, the sheet S which is transported from the front driving roller 31 to the rear driving roller 32 is supported on the outer peripheral surface of the rotating drum 30. In addition, the process unit 3U is provided in the processor 3 in order to print a color image with respect to the front surface of the sheet S which is supported by the rotating drum 30. In the process unit 3U, printing heads 36*a* to 36*d*, and UV irradiators 37*a* and 37*b* are supported by a unit support member 35. The unit support member 35 supports the printing heads 36*a* to 36*d*, and the UV irradiators 37*a* and 37*b* by pinching the units and irradiators in the forward and backward direction Y using two unit supporting flat plates which have arc shapes which go along the cylindrical shape of the rotating drum 30. In addition, as illustrated in FIG. 1, a gap Δ is provided between the unit support member 35 (unit supporting flat plate thereof) and the rotating drum 30.

The four printing heads 36*a* to 36*d* which are aligned in order in the transport direction Ds correspond to yellow, cyan, magenta, and black, and eject ink of a corresponding color from nozzles in an ink jet method. The four printing heads 36*a* to 36*d* are radially arranged from the rotational axis of 302 of the rotating drum 30, and are aligned along the outer peripheral surface of the rotating drum 30. In addition, each of the printing heads 36*a* to 36*d* is positioned with respect to the rotating drum 30 by the unit support member 35, and faces the rotating drum 30 with slight clearance (platen gap). In this manner, each of the printing heads 36*a* to 36*d* faces the front surface of the sheet S which is wound up in the rotating drum 30 with a predetermined paper gap. When ink is ejected from each of the printing heads 36*a* to 36*d* in a state in which the paper gap is regulated by the unit support member 35 in this manner, ink lands on a desired position on the front surface of the sheet S, and a color image is formed on the front surface of the sheet S.

As ink which is used in the printing heads 36*a* to 36*d*, there is ultraviolet (UV) ink (photocurable ink) which is cured by being irradiated with ultra violet rays (light). Therefore, in the process unit 3U, UV irradiators 37*a* and 37*b* are provided in order to fix ink on the sheet S by curing the ink. In addition, the curing of ink is performed in two stages of temporary curing and main curing. The UV irradiator 37*a* for temporary curing is arranged between each of the four printing heads 36*a* to 36*d*. That is, the UV irradiator 37*a* cures ink to such a degree that shape of ink is not lost (temporary curing) by radiating relatively weak UV rays, and does not cure the ink completely. On the other hand, the UV irradiator 37*b* for the main curing is provided on the downstream side in the transport direction Ds with respect to the four printing heads 36*a* to 36*d*. That is, the UV irradiator 37*b* completely cures (main curing) the ink by radiating UV rays which are stronger than those of the UV irradiator 37*a*. It is possible to fix a color image which is formed by the plurality of printing heads 36*a* to 36*d* on the front surface of the sheet S by executing the temporary curing and the main curing in this manner.

The process unit 3U is configured by mounting the printing heads 36*a* to 36*d*, and the UV irradiators 37*a* and 37*b* on the unit support member 35 in this manner. In addition, the unit support member 35 is bridged between two rails 351 which extend in the forward and backward direction in the x direction, and is movable in the forward and backward direction Y on the rail 351 along with the printing heads 36*a* to 36*d*, and the UV irradiators 37*a* and 37*b*. That is, the process unit 3U is movable in the forward and backward direction Y. In addition, as will be described later using FIG. 2, the process unit 3U appropriately moves between a printing position and a maintenance position which are aligned in the forward and backward direction Y.

The sheet S on which the color image is formed by the process unit 3U is transported to the winding unit 4 by the rear driving roller 32. The winding unit 4 includes a driven roller 41 which winds up the sheet S from the rear surface side between the winding axis 40 and the rear driving roller 32, in addition to the winding axis 40 which winds up the end of the sheet S. The winding axis 40 supports the end of the sheet S by winding up the end of the sheet in a state in which the front surface of the sheet S faces the outside. That is, when the winding axis 40 rotates clockwise on the paper plane in FIG. 1, the sheet S which is transported from the rear driving roller 32 is wound around the winding axis 40 via the driven roller 41. Incidentally, the sheet S is wound around the winding axis 40 through a core tube (not shown) which is detachable from the winding axis 40. Accordingly, when the sheet S which is wound around the winding axis 40 is full, it is possible to detach the sheet S in each core tube.

Meanwhile, as will be described later, the UV irradiator 37*b* includes a cooling mechanism for cooling down the light source which radiates UV rays. The cooling mechanism cools down the light source using a current of air in which air is taken in from the outside of the housing member 10, and is discharged to the outside of the housing member 10. Therefore, an air inlet 51 which takes in air from the outside, and an air outlet 53 which ejects air to the outside are provided with respect to the UV irradiator 37*b* in the housing member 10. Specifically, the air inlet 51 and the air outlet 53 are configured of a louver, or the like, which opens to the housing member 10. In addition, an air inlet duct 55 which is led from the air inlet 51 to the UV irradiator 37*b*, and an air outlet duct 57 which is led from the UV irradiator 37*b* to the air outlet 53 are provided with respect to the UV irradiator 37*b* in the housing member 10. The air inlet duct 55 includes one end opening which is open to the air inlet 51, and the other end opening which is open to a cooling fan 67 (to be described later in FIG. 2) of the UV irradiator 37*b*. The air outlet duct 57 includes one end opening which is open to the cooling fan 67 of the UV irradiator 37*b*, and the other end opening which is open to the air outlet 53. The ducts 55 and 57 which are provided between the air inlet 51 and the air outlet 53 guide air along a guiding path Pg which is led to the air outlet 53 through the UV irradiator 37*b* from the air inlet 51.

The above description is a schematic configuration of the printing device 1. As described above, the UV irradiator 37*b* which radiates relatively strong light is provided in the printing device 1. Since such a UV irradiator 37*b* drives the light source which is configured of a Light Emitting Diode (LED), or the like, so as to irradiate strong UV rays, a temperature of the light source rises. However, illuminance of the light source is changed due to the temperature rise. Therefore, the UV irradiator 37*b* stabilizes the illuminance of the light source using a cooling mechanism which cools down the light source. Subsequently, such a UV irradiator 37*b*, and a configuration relating thereto will be described.

Figure 2:
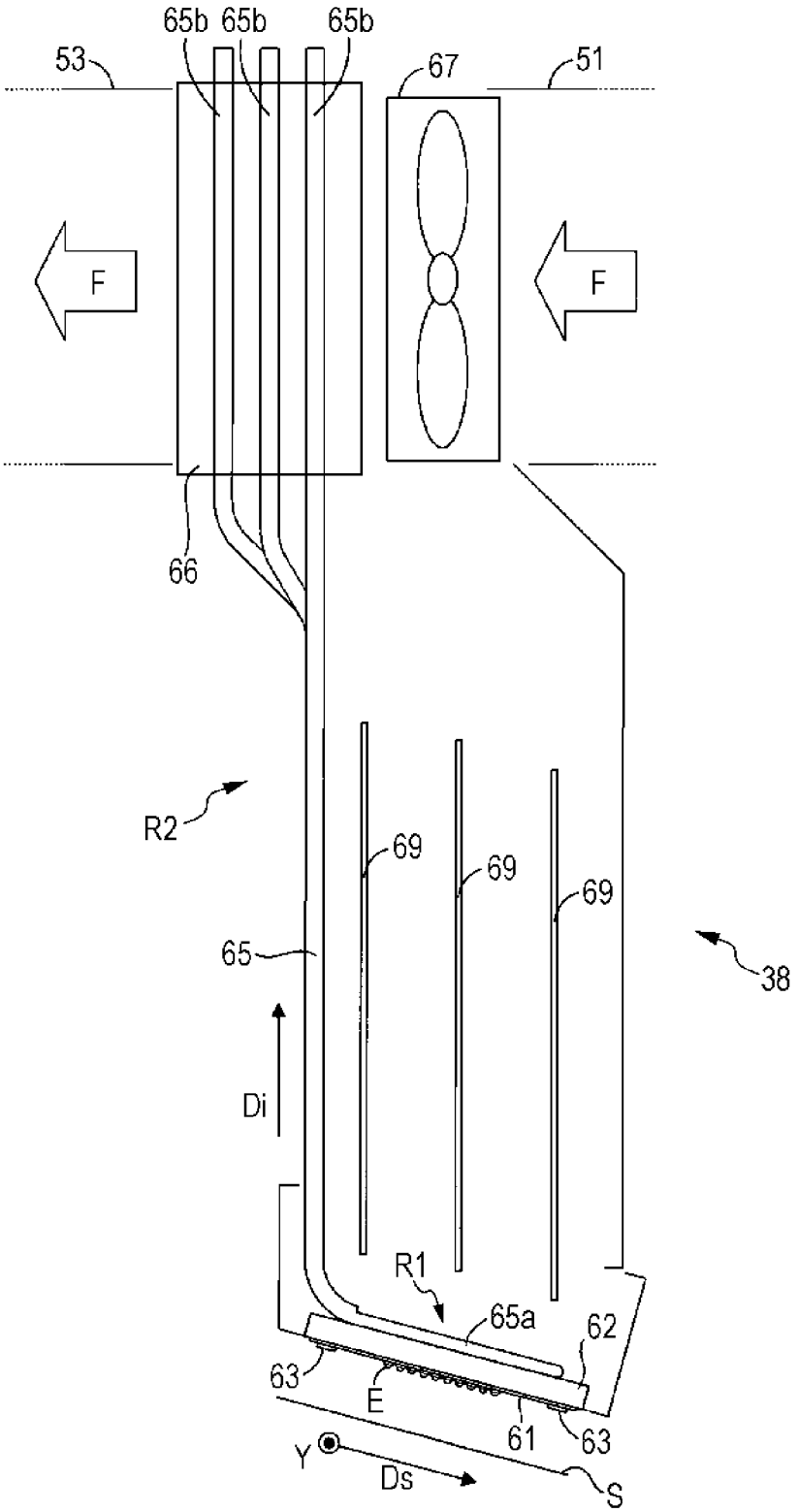
FIG. 2 is a diagram which schematically exemplifies a configuration of a UV irradiator.
Figure 3:
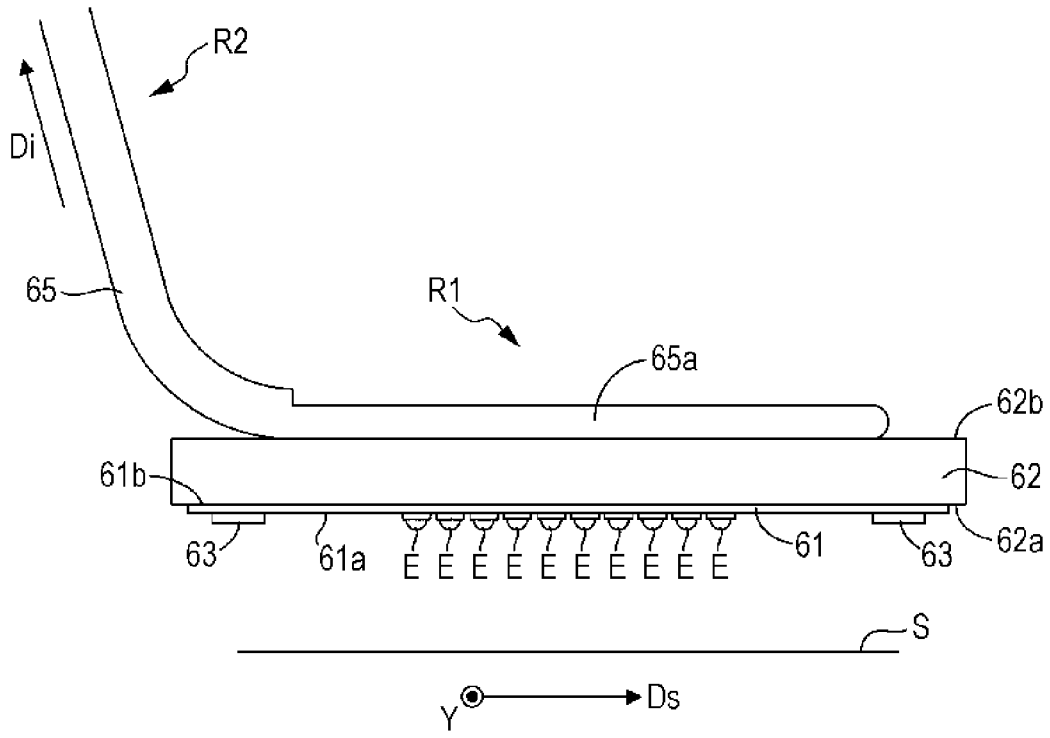
FIG. 3 is a diagram which exemplifies an example in which the vicinity of a light source included in the UV irradiator is partially enlarged.

FIG. 2 is a diagram which schematically exemplifies a configuration of the UV irradiator. FIG. 3 is a diagram which exemplifies the vicinity of the light source which is included in the UV irradiator by partially enlarging the vicinity of the light source. In addition, in FIGS. 2 and 3, the sheet S and the sheet transport direction Ds are illustrated in a region which the UV irradiator 37*b* faces. As described above, the sheet S and the sheet transport direction Ds are bent along the outer peripheral surface of the rotating drum 30. However, in FIGS. 2 and 3, in a short region which the UV irradiator 37*b* faces, the UV irradiator is displayed so as to be similar to a straight line shape.

The UV irradiator 37*b* has a configuration in which a plurality of light sources E (LED) are arranged on the front surface 61*a* of a light source substrate 61 (LED substrate) of a planar plate shape. In the light source substrate 61, the plurality of light sources E are aligned in both directions of the forward and backward direction Y and the sheet transport direction Ds which is orthogonal to the forward and backward direction Y, and in other words, the plurality of light sources E are arranged in a matrix in the forward and backward direction Y, and the sheet transport direction Ds. The front surface 61*a* of the light source substrate 61 faces the sheet S, and each light source E which is arranged on the front surface 61*a* radiates strong UV rays which can cure the UV ink toward the sheet S.

In addition, the UV irradiator 37*b* includes a planar plate-shaped support substrate 62 which supports the light source substrate 61. Specifically, the light source substrate 61 is fixed to the support substrate 62 using a screw 63 in a state in which the front surface 61*a* of the light source substrate 61 (surface on the side opposite to front surface 61*a*) and the front surface 62*a* of the support substrate 62 are bonded through a heat conduction grease layer. The support substrate 62 is metal such as copper or aluminum, and a heat conduction member having high heat conductivity.

In addition, the UV irradiator 37*b* includes a heat pipe 65 which is connected to the support substrate 62. The heat pipe 65 has a shape in which a bar is bent, and three heat pipes are provided in the forward and backward direction Y. Specifically, a portion to be connected 65*a* which is provided at one end of the heat pipe 65 is joined to the rear surface 62*b* of the support substrate 62 (surface on the side opposite to front surface 62*a*) using soldering through a solder layer. In this manner, the portion to be connected 65*a* of the heat pipe 65 which is connected to the light source substrate 61 through the support substrate 62 comes into thermal contact with the light source E of the light source substrate 61. That is, the heat of the light source E is conducted to the portion to be connected 65*a* of the heat pipe 65 through the support substrate 62. In addition, the portion to be connected 65*a* is provided so as to include a range in which the plurality of light sources E are arranged in the sheet transport direction Ds, and high heat conductivity to the portion to be connected 65*a* from each light source E is secured.

The heat pipe 65 is roughly classified into a first region R1 and a second region R2. The first region R1 of the heat pipe 65 is a region which extends in the sheet transport direction Ds in parallel to the main surface (front surface 61*a* and rear surface 61*b*) of the light source substrate 61, and is a region in which the above described portion to be connected 65*a* is provided. On the other hand, the second region R2 of the heat pipe 65 is a region which extends in an extending direction Di which is further separated from the light source substrate 61 than the first region R1 by extending in the extending direction Di which crosses the main surface (front surface 61*a* and rear surface 61*b*) of the light source substrate 61 by being bent from the first region R1.

A portion to be cooled 65*b* is provided at a tip portion (the other end of heat pipe 65) to which the second region R2 extends from the first region R1. That is, according to the embodiment, the portion to be cooled 65*b* is drawn to a position which is further separated than the portion to be connected 65*a* in the extending direction Di with respect to the light source substrate 61. For example, according to the embodiment, at least a part of the portion to be cooled 65*b* is arranged so that the portion to be cooled is located at the side which is farther from the rotating drum 30 than the end portion of the printing heads 36*a* to 36*d* on the side which is far from the rotating drum (or sheet S) in the radial direction of the rotating drum 30. In addition, the heat pipe 65 performs heat transportation in which heat of the light source E which is received in the portion to be connected 65*a* is transported to the portion to be cooled 65*b*.

The portion to be cooled 65*b* of the heat pipe 65 has a heat radiation member 66 attached which is configured by arranging a plurality of fins. Specifically, the portion to be cooled 65*b* of each heat pipe 65 is press-fitted into a through hole through which the plurality of fins pass in the extending direction Di, and the fins of the a heat radiation member 66 configuring the heat radiation member 66 and the portion to be cooled 65*b* come into thermal contact with each other.

In addition, the UV irradiator 37*b* includes a cooling fan 67 which cools down the portion to be cooled 65*b*. The cooling fan 67 faces the portion to be cooled 65*b* and the heat radiation member 66 in a direction which crosses (crosses at right angles) the extending direction Di, and sends wind toward the portion to be cooled 65*b* and the heat radiation member 66. Specifically, the portion to be cooled 65*b*, the heat radiation member 66, and the cooling fan 67 are arranged on the guiding path Pg on which the ducts 55 and 57 guide air. In addition, the cooling fan 67 sends ambient air (air outside of housing member 10) which is taken in from the air inlet 51 through the air inlet duct 55 toward the portion to be cooled 65*b* and the heat radiation member 66, and then generates a current of air F which is discharged from the air outlet 53 through the air outlet duct 57. In this manner, the current of air F which is generated in the cooling fan 67 is supplied to the portion to be cooled 65*b* and the heat radiation member 66, and the portion to be cooled 65*b* and the heat radiation member 66 are cooled down.

In addition, three drive circuit substrates 69 on which a drive circuit which drives the light source E of the light source substrate 61 is mounted are arranged so as to align in the sheet transport direction Ds in the UV irradiator 37*b*. Each drive circuit substrate 69 is arranged side by side with the heat pipe 65 between the light source substrate 61 and the portion to be cooled 65*b* in the extending direction Di. In addition, each drive circuit substrate 69 supplies a driving signal to the light source E through a signal line which is not shown, and causes the light source E to emit light. In addition, an amount of luminescence with respect to a magnitude of the driving signal is different depending on the light source E. Therefore, each drive circuit substrate 69 supplies a driving signal to each light source E by adjusting a magnitude of a driving signal in each light source E so that the amount of luminescence of each light source E fits in a predetermined range.

As described above, according to the embodiment, the UV irradiator 37*b* including the light source substrate 61 which is arranged facing the sheet S is provided, and the light source E which radiates UV rays to ink is provided in the light source substrate 61. In addition, the portion to be connected 65*a* of the heat pipe 65 which performs heat transportation from the portion to be connected 65*a* to the portion to be cooled 65*b* is connected to the light source substrate 61, and comes into thermal contact with the light source substrate 61. On the other hand, the portion to be cooled 65*b* of the heat pipe 65 is located at a position which is farther separated than the portion to be connected 65*a* with respect to the light source substrate 61, and the cooling fan 67 is arranged facing the portion to be cooled 65*b* which is drawn from the light source substrate 61 in this manner, and cools down the portion to be cooled 65*b*. Accordingly, the heat of the light source E is transported to the portion to be cooled 65*b* of the heat pipe 65 which is separated from the light source substrate 61 through the portion to be connected 65*a* of the heat pipe 65 which is connected to the light source substrate 61. In addition, the heat of the light source E which is transported to the portion to be cooled 65*b* is lost due to the cooling fan 67.

Incidentally, the cooling fan 67 faces the portion to be cooled 65*b* of the heat pipe 65 which is drawn from the light source substrate 61, and is arranged by being separated from the light source E. For this reason, the cooling fan 67 can cool down the portion to be cooled 65*b* using air which is relatively colder than air in the vicinity of the light source E, and to efficiently radiate the heat of the light source E which is transported to the portion to be cooled 65*b*. As a result, according to the embodiment, it is possible to efficiently cool down the light source E of the UV irradiator 37*b*.

In addition, according to the embodiment, there is an effect of excellently maintaining a straight advancing property of ink which is ejected from the printing heads 36*a* to 36*d* without depending on the current of air which is generated by the cooling fan 67. That is, as is disclosed in JP-A-2010-000735, in a configuration in which wind is directly sent to the light source from the cooling fan, wind which passes through the light source is spread along the front surface of the sheet S after colliding with the sheet S facing the light source. As a result, a current of air which crosses between the printing heads 36*a* to 36*d* and the front surface of the sheet S is generated, and there is a concern that the straight advancing property of the ink which is ejected from the printing heads 36*a* to 36*d* may not be maintained. In contrast to this, according to the embodiment, the cooling fan 67 faces the portion to be cooled 65*b* of the heat pipe 65 which is drawn from the light source substrate 61, and is arranged by being separated from the light source E. Accordingly, it is possible to excellently maintain the straight advancing property of the ink which is ejected from the printing heads 36*a* to 36*d* by suppressing generating of a current of air which crosses between the printing heads 36*a* to 36*d* and the front surface of the sheet S.

In addition, the cooling fan 67 cools down the portion to be cooled 65*b* of the heat pipe 65 using air which is taken in from the outside of the housing member 10. With such a configuration, it is possible to cool down the portion to be cooled 65*b* using cold air which is taken in from the outside of the housing member 10, and to contribute to improving of the cooling efficiency of the light source E of the UV irradiator 37*b*.

In addition, the cooling fan 67 discharges air which has cooled down the portion to be cooled 65*b* of the heat pipe 65 to the outside of the housing member 10. With such a configuration, it is possible to maintain an internal temperature of the housing member 10 to be relatively low in order to discharge the air which is warmed by being used in cooling down of the portion to be cooled 65*b* to the outside of the housing member 10, and to contribute to improving of the cooling efficiency of the light source E of the UV irradiator 37*b*.

Incidentally, the ducts 55 and 57 which are provided between the air inlet 51 and the air outlet 53 which are provided in the housing member 10, and guide air to the air outlet 53 from the air inlet 51 are provided, and the portion to be cooled 65*b* and the cooling fan 67 are arranged on the guiding path Pg on which the ducts 55 and 57 guide air. By providing the ducts 55 and 57 which guide air in this manner, it is possible to efficiently take in cold air from the outside of the housing member 10, to use in cooling down of the portion to be cooled 65*b*, and to efficiently discharge the air which is warmed by being used in cooling down of the portion to be cooled 65*b* to the outside of the housing member 10. Incidentally, according to the embodiment, the portion to be cooled 65*b* of the heat pipe 65 is located at a position which is drawn from the light source E, and at least a part of the portion to be cooled 65*b* is arranged so as to be located on the side which is farther from the rotating drum 30 than the end portion of the printing heads 36*a* to 36*d* on the side which is far from the rotating drum 30 in the radial direction of the rotating drum 30. Accordingly, it is not necessary to extend the ducts 55 and 57 to the light source E from the air inlet 51 or the air outlet 53, and it is possible to make the ducts 55 and 57 short compared to a case in which the ducts 55 and 57 are extended to the light source E from the air inlet 51 or the air outlet 53. Since it is possible to form the ducts 55 and 57 to be short in this manner, a pressure loss of a current of air by the cooling fan 67 can be reduced. Accordingly, when the same cooling fan is used, it is possible to increase a cooling efficiency compared to a case in which the ducts 55 and 57 are long.

In addition, according to the embodiment, a heat radiation member 66 which is connected to the portion to be cooled 65*b* is provided at a position facing the cooling fan 67, and the portion to be cooled 65*b* and the heat radiation member 66 come into thermal contact with each other. By providing the heat radiation member 66 in the portion to be cooled 65*b* in this manner, it is possible to further increase the cooling efficiency of the light source E of the UV irradiator 37*b* by efficiently radiating the heat from the portion to be cooled 65*b*.

Meanwhile, the cooling fan 67 faces the portion to be cooled 65*b* of the heat pipe 65 which is drawn from the light source substrate 61, and is arranged by being separated from the light source E. In other words, the cooling fan 67 for cooling down the light source E is separated from the vicinity of the light source E, and a space in the vicinity of the light source E can be used for arranging components other than the cooling fan 67 for the light source E. Therefore, the drive circuit substrate 69 is arranged in the vicinity of the light source E using the space in the vicinity of the light source E. As a result, for example, it is possible to reduce influence of noise on a signal line by making the signal line which is led to the light source E from the drive circuit substrate 69 short. In addition, since the drive circuit substrate 69 and the light source E can be arranged so as to be close to each other, it is possible to exchange the drive circuit substrate 69 and the light source substrate 61 together when exchanging the elements, and there also is an effect of simply performing a work for exchanging.

In addition, according to the embodiment, the heat pipe 65 is connected to the light source substrate 61 through the support substrate 62 as the heat conduction member. With such a configuration, it is possible to efficiently conduct heat to the light source substrate 61 from the light source E, and as a result, it is possible to contribute to improving of the cooling efficiency of the light source E.

In this manner, according to the embodiment, the printing device 1 corresponds to an example of the "image recording apparatus" of the present invention, the printing heads 36*a* to 36*d* correspond to examples of the "ejecting head" of the present invention, the UV irradiator 37*b* corresponds to an example of the "light irradiator" of the present invention, the light source substrate 61 corresponds to an example of the "light source substrate" of the present invention, the light source E corresponds to the "light source" of the present invention, the heat pipe 65 corresponds to an example of the "heat transport member" of the present invention, the portion to be connected 65*a* of the heat pipe 65 corresponds to an example of the "portion to be connected" of the present invention, the portion to be cooled 65*b* of the heat pipe 65 corresponds to an example of the "portion to be cooled" of the present invention, and the cooling fan 67 corresponds to an example of the "cooling fan" of the present invention. In addition, the housing member 10 corresponds to an example of the "exterior member" of the present invention, the air inlet 51 corresponds to an example of the "air inlet" of the present invention, the air outlet 53 corresponds to an example of the "air outlet" of the present invention, the ducts 55 and 57 correspond to examples of the "ventilation member" of the present invention, the guiding path Pu corresponds to an example of the "guiding path" of the present invention, the heat radiation member 66 corresponds to an example of the "heat radiation member" of the present invention, the drive circuit substrate 69 corresponds to an example of the "drive circuit substrate" of the present invention, the sheet S corresponds to an example of the "recording medium" of the present invention, and the UV ink corresponds to an example of the "liquid" of the present invention.

In addition, the present invention is not limited to the embodiment, and it is possible to add various modifications with respect to the above described embodiment without departing from the scope of the invention. For example, according to the embodiment, the cooling fan 67 is a so-called ventilation fan which cools down the portion to be cooled 65*b* of the heat pipe 65 by sending wind. However, the cooling fan 67 may be configured by a so-called exhaust fan which cools down the portion to be cooled 65*b* of the heat pipe 65 by discharging air. Alternatively, a configuration in which both the ventilation fan and the exhaust fan are provided, and are caused to function as the cooling fan 67, respectively, may be possible. In addition, according to the embodiment, the UV irradiator 37*b* includes the cooling fan, however, the cooling fan may be provided in the air inlet duct 55, or the air outlet duct 57.

In addition, according to the embodiment, the portion to be connected 65*a* of the heat pipe 65 is indirectly connected to the light source substrate 61 through the support substrate 62. However, the portion to be connected 65*a* of the heat pipe 65 may be directly connected to the light source substrate 61 not through another member.

In addition, according to the embodiment, the portion to be cooled 65*b* of the heat pipe 65 is directly connected to the heat radiation member 66. However, the portion to be cooled 65*b* of the heat pipe 65 may be indirectly connected to the heat radiation member 66 through another member. At this time, it is preferable to use a heat conduction member such as metal as another member which is interposed between the portion to be cooled 65*b* and the heat radiation member 66.

In addition, according to the embodiment, a mechanism for cooling down the light source E which is provided in the UV irradiator 37*b* for main curing is not provided in the UV irradiator 37*a* for temporary curing. The reason why is that a light amount of UV rays which is radiated by the UV irradiator 37*a* for temporary curing is small, and accordingly there is no problem in a temperature rise in the light source. However, as a matter of course, a mechanism for cooling down the light source E may be provided in the UV irradiator 37*a* for temporary curing.

In addition, it is also possible to appropriately change a type, an arrangement, the number of the light sources E, or a shape, a size, an arrangement of the heat pipe 65, or the like. It is also possible to appropriately change a shape, a size, the number, and an arrangement of the light source substrates 61, a specific configuration of the heat radiation member 66, and a shape, a size, the number, and an arrangement, or the like, of the drive circuit substrate 69. In addition, the heat transport member which can be used in the invention is not limited to the heat pipe 65, and it is also possible to use a cooling pipe, or the like, for example. In addition, the heat radiation member 66, the air inlet 51, the air outlet 53, and the ducts 55 and 57 are not essential, and may be omitted.

The member which supports the transported sheet S is not limited to a cylindrical shape such as the rotating drum 30. Accordingly, it is also possible to use a flat platen which planarly supports the sheet S.

The entire disclosure of Japanese Patent Application No. 2013-054691, filed Mar. 18, 2013 is expressly incorporated by reference herein.

What is claimed is:

1. An image recording apparatus comprising:

an ejecting head which is arranged so as to face a recording medium, and ejects photocurable liquid which is cured by being irradiated with light onto the recording medium; and a light irradiator which radiates the light to the liquid which is ejected onto the recording medium by the ejecting head, wherein the light irradiator includes:

a light source substrate which is arranged so as to face the recording medium, and includes a light source which radiates the light to the recording medium;

a heat transport member which includes a portion to be connected which is in thermal contact with the light source substrate by being connected to the light source substrate directly or indirectly, and a portion to be cooled which is located at a position which is further separated from the light source substrate than the portion to be connected, and transports heat from the portion to be connected to the portion to be cooled;

a cooling fan which is arranged so as to face the portion to be cooled, and cools down the portion to be cooled; and a drive circuit substrate that includes a circuit driving the light source of the light source substrate, and the drive circuit substrate is arranged between the light source substrate and the portion to be cooled.

2. The image recording apparatus according to claim 1, further comprising:

an exterior member which accommodates the recording medium, the ejecting head, and the light irradiator, wherein the cooling fan cools down the portion to be cooled using air which is taken in from an outside of the exterior member.

3. The image recording apparatus according to claim 2, wherein the cooling fan discharges air which cools down the portion to be cooled to the outside of the exterior member.

4. The image recording apparatus according to claim 3, wherein the exterior member includes an air inlet and an air outlet which are open to the outside, and the cooling fan discharges air which is taken in from the air inlet from the air outlet after using the air in cooling down of the portion to be cooled.

5. The image recording apparatus according to claim 4, further comprising:

a ventilation member which is provided between the air inlet and the air output, and guides air from the air inlet to the air outlet, wherein the portion to be cooled and the cooling fan are arranged on a guiding path on which the ventilation member guides air.

6. The image recording apparatus according to claim 1, further comprising:

a heat radiation member which is connected to the portion to be cooled directly or indirectly at a position which faces the cooling fan, and is in thermal contact with the portion to be cooled.

7. The image recording apparatus according to claim 1, wherein the drive circuit substrate is arranged so as to align with the heat transport member.

8. The image recording apparatus according to claim 1, wherein the heat transport member is a heat pipe.

9. The image recording apparatus according to claim 8, wherein the heat pipe includes a first region which extends in parallel to a main surface of the light source substrate, a second region which extends in a direction which is further separated from the light source substrate than the first region by extending in a direction which crosses the main surface of the light source substrate by being bent from the first region, in which the portion to be connected is provided in the first region, and the portion to be cooled is provided in the second region.

10. The image recording apparatus according to claim 1, wherein at least a part of the portions to be cooled is arranged at a position which is farther from the recording medium than an end portion of the ejecting head on a side which is opposite to a recording medium side.

* * * * *